US005615798A

United States Patent [19]

Luburic et al.

[11] Patent Number: 5,615,798

[45] Date of Patent: Apr. 1, 1997

[54] CONTAINER INCORPORATING LIQUID DRAINING MEANS, AND RELATED METHOD

[75] Inventors: Frano Luburic, Fullerton; C. Richard Roper, Orange, both of Calif.

[73] Assignee: Ropak Corporation, Fullerton, Calif.

[21] Appl. No.: 302,597

[22] Filed: Sep. 8, 1994

[51] Int. Cl.[6] ..... B65D 1/34

[52] U.S. Cl. ..... 220/572; 220/601; 220/608; 220/625; 220/DIG. 6

[58] Field of Search ..... 220/608, 572, 220/625, DIG. 6, 627, 626, 571, 694, 729, 731, DIG. 21, 601, 630

[56] References Cited

U.S. PATENT DOCUMENTS

| | | | |
|---|---|---|---|
| D. 143,128 | 12/1945 | Butler | 220/DIG. 6 |
| 435,148 | 8/1890 | Mansfield | 220/572 |
| 1,334,342 | 3/1920 | Woods | 220/627 |
| 1,692,003 | 11/1928 | Thayer | 220/572 |
| 3,050,073 | 8/1962 | McMillan | 220/572 |
| 3,405,858 | 10/1968 | Collie | 220/608 |
| 3,884,383 | 5/1975 | Burch et al. | 220/608 |
| 3,902,599 | 9/1975 | Stromberg | 220/DIG. 6 |
| 4,206,845 | 6/1980 | Christian | 220/608 |
| 4,405,048 | 9/1983 | Peake | 220/DIG. 6 |
| 4,533,585 | 8/1985 | Holden | 220/DIG. 6 |
| 4,785,958 | 11/1988 | Snyder | 220/DIG. 6 |
| 5,183,179 | 2/1993 | Morris, Sr. | 220/729 |
| 5,346,094 | 9/1994 | Strawser | 220/608 |

FOREIGN PATENT DOCUMENTS

| | | | |
|---|---|---|---|
| 935405 | 10/1973 | Canada | 220/DIG. 6 |
| 484709 | 5/1992 | European Pat. Off. | 220/608 |
| 2402599 | 5/1979 | France | 220/DIG. 6 |
| 2433734 | 1/1976 | Germany | 220/DIG. 6 |
| 975293 | 11/1964 | United Kingdom | 220/601 |

*Primary Examiner*—Stephen J. Castellano
*Attorney, Agent, or Firm*—J. Mark Holland

[57] ABSTRACT

A container for transporting particulate matter which is initially in slurry form has a base and a sidewall portion extending upwardly therefrom and is characterized by a downwardly extending, integrally-formed peripheral drainage channel having a drainage opening at a normally lowest point therein. The container bottom is configured to urge liquid from the slurry toward the channel, and the channel is configured to urge the liquid toward the drainage opening. The sidewall portion defines an opening coverable by a lid. A liner may be used to improve the drainage of the liquid from the slurry and from the container, and a plug can be placed in the drainage opening after liquid has drained from the slurry and the container. A supplemental elevating member can be utilized to elevate the slurry with respect to the channel. A method of use of the container is disclosed.

14 Claims, 7 Drawing Sheets

CONTAINER INCORPORATING LIQUID DRAINING MEANS, AND RELATED METHOD

BACKGROUND OF THE INVENTION

This invention relates to containers in general, and specifically to a container for particulate matter which matter is initially in slurry form. The container is especially well-suited for use in transporting and processing fish roe for human consumption.

Particulate matter such as fish roe is sometimes processed in slurry form. While aiding in certain processing steps, the slurry form eventually becomes undesirable at certain points in certain applications. Accordingly, it becomes necessary and/or desirable to drain the liquid (or some portion thereof) from the slurry. The remaining particulate matter (such as fish roe) is then further processed, transported, distributed, consumed, etc. without the liquid component (or with a reduced liquid component) of the slurry.

By way of example, present fish roe processing techniques and apparatus commonly include a container having a base portion and a sidewall portion extending upwardly therefrom when the container is in its normally upright position. The sidewall has an upper end that defines an opening. After roe is placed into the container through the opening, a lid is typically engaged with the upper end of the sidewall to cover the opening and seal the container prior to transport, storage, etc.

The roe is typically processed in a slurry form prior to being placed in the container. For various reasons, it is desirable to remove or reduce the amount of liquid from the slurry contemporaneously with placing it into the container. To that end, the base portion of such prior art containers typically includes a drainage hole, and the bottom of the container is configured to urge the liquid toward the drainage hole.

The draining function in some prior art containers is improved by placing a separate elevating member on the bottom prior to placing the roe in the container. A plastic liner is placed over the elevating member and the roe is then placed on the liner. The combination of the elevating member and the liner spaces the roe slurry from the bottom of the container, thereby permitting the liquid to drain (and to even be mechanically pressed) from the slurry and out of the container more effectively. In other words, a space is formed under the slurry to permit the liquid to drain out of the slurry onto the bottom of the container and then out the drainage hole.

Such prior art systems, while functionally effective to drain and transport the roe, have numerous shortcomings. For example, additional material and manufacturing are required to mold the elevating member that is placed into the container prior to filling it with roe. By way of further example, the assembly process is complicated by the need to assemble and maintain the separate elevating member with the rest of the container.

OBJECTS AND ADVANTAGES OF THE INVENTION

It is, therefore, an object of our invention to provide an improved container for transporting, processing and/or handling slurries such as fish roe. The container of our invention is characterized by a base portion and a sidewall portion extending upwardly therefrom when the container is in its normally upright position, in which the base portion includes a central portion and an integrally-formed sluice channel therearound. The channel is preferably configured to receive liquid from the slurry when the container is in its normally upright position, and is located at the periphery of the base portion.

Another object of our invention is the provision of a container of the aforementioned character, in which the channel and bottom portion are configured to be used in connection with prior art separate central elevating members. As indicated above, these prior art elevating members typically have a normally relatively upwardly positioned central portion and skirt means extending downwardly therefrom. To further improve the drainage function of our invention, the skirt means of the prior art elevating members is preferably engagable in the sluice channel. This increases the drainage space and differential between the bottom of the slurry and the bottom of the container and/or channel.

A further object of our invention is the provision of a container of the aforementioned character, further including a drainage opening in the channel, with the channel configured to urge the liquid toward the drainage opening. A plug member can be utilized to plug the opening after liquid has drained from the slurry and container.

Still another object of our invention is the provision of a container of the aforementioned character, in which the central portion of the base portion is configured to urge the liquid from the slurry toward the channel when the container is in its normally upright position. Preferably, a liner such as used in prior art devices can also be used in connection with the container of our invention, to further enhance the drainage function.

An additional object of our invention is the provision of a method of transporting fish roe, including the steps of providing a container of the aforementioned character, having a base portion with a central portion and a sluice channel therearound, the channel being formed integrally with the central portion and configured to receive liquid from the slurry when the container is in its normally upright position; placing a slurry of fish roe into the container; sealing the container; and transporting the container. Preferably, the channel includes a drainage opening at its lowest point, and the method includes the steps of allowing liquid to drain from the slurry through the opening and subsequently plugging the opening to prevent further drainage.

Yet another object of our invention is the provision of a method of the aforementioned character, further including the step of placing a central elevating member into the container before placing the slurry of fish roe into the container to elevate the slurry with respect to the channel. As with prior art devices, a liner can also be placed in the container prior to placing the slurry of fish roe into the container, so that the liner is between the slurry and the container.

Other objects and advantages of the invention will be apparent from the following specification and the accompanying drawings, which are for the purpose of illustration only.

DESCRIPTION OF PREFERRED EMBODIMENT

Figure 1:
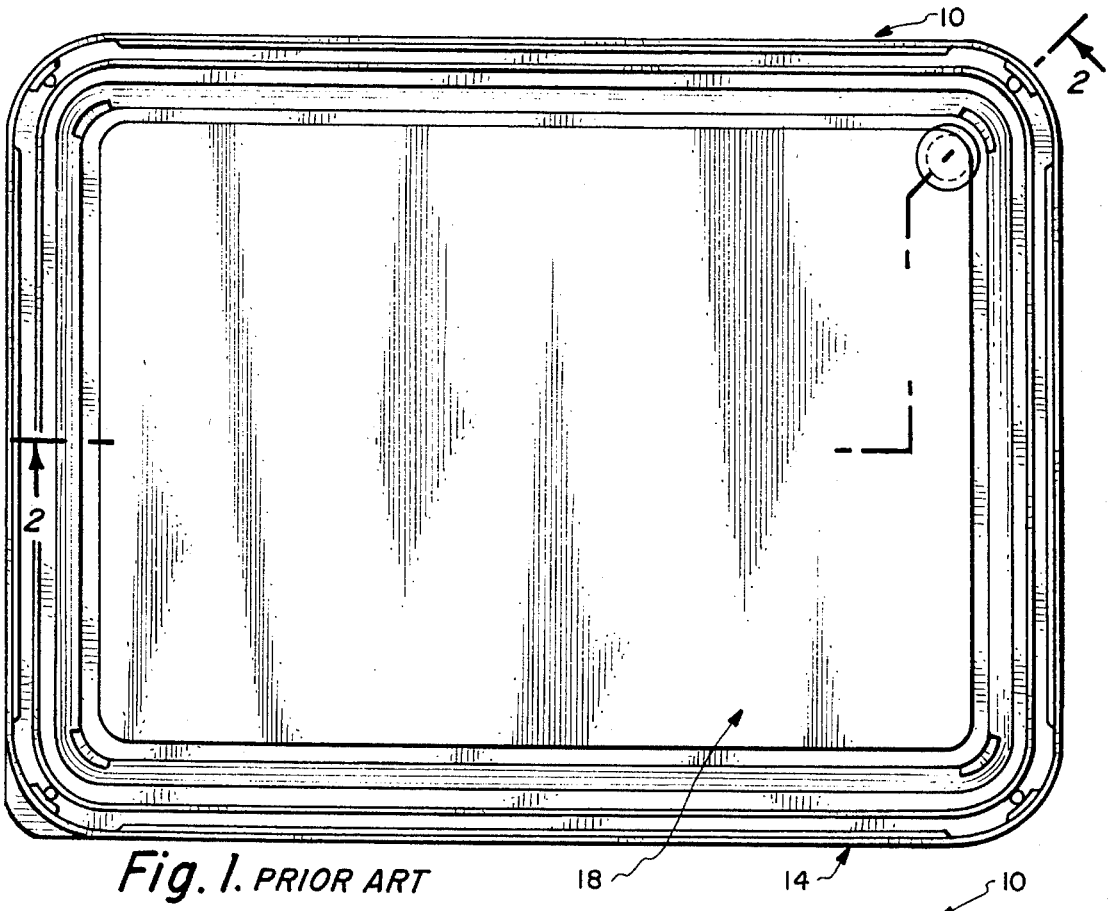
Fig. 1. PRIOR ART
FIG. 1 is a plan view of a prior are container.

Referring now to the drawings, and particularly to FIGS. 1–4 thereof, we show a typical prior art container 10 for transporting fish roe for human consumption. The container is shown without its associated lid, liner means, and plug members, but the lid, liner means, and plug members described below in relation to the present invention are similar to those usable with this prior art container.

Figure 2:
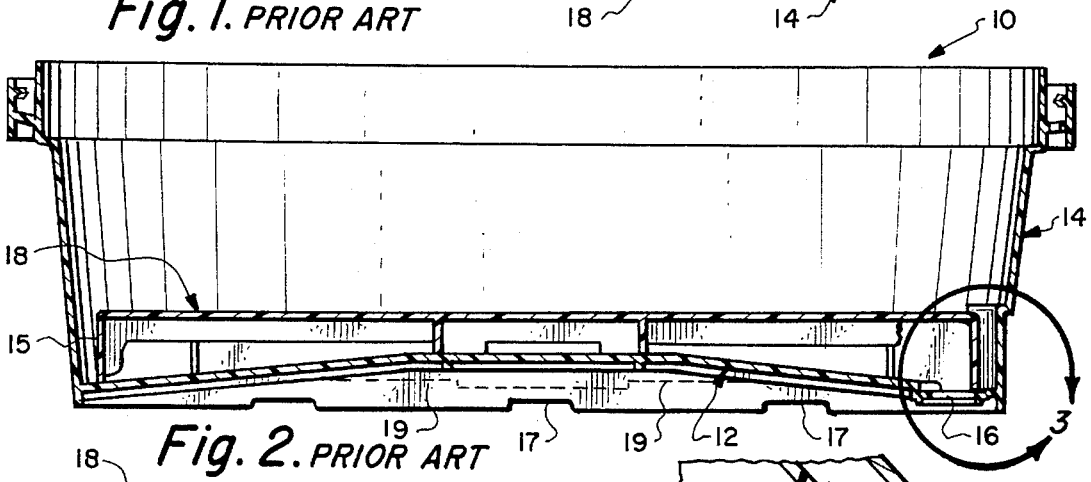
Fig. 2. PRIOR ART
FIG. 2 is a sectional view taken along line 2—2 of FIG. 1.
Figure 3:
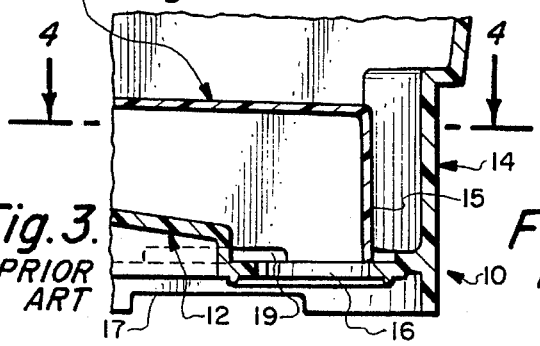
Fig. 3. PRIOR ART
FIG. 3 is a broken sectional view taken along line 3—3 of FIG. 2.
Figure 4:
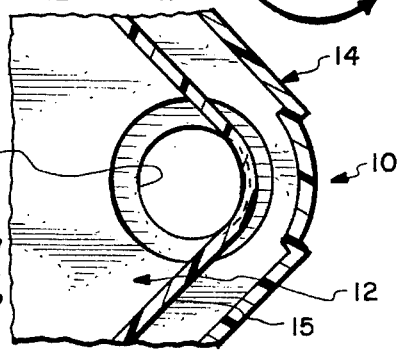
Fig. 4. PRIOR ART
FIG. 4 is a sectional view taken along line 4—4 of FIG. 3.
Figure 5:
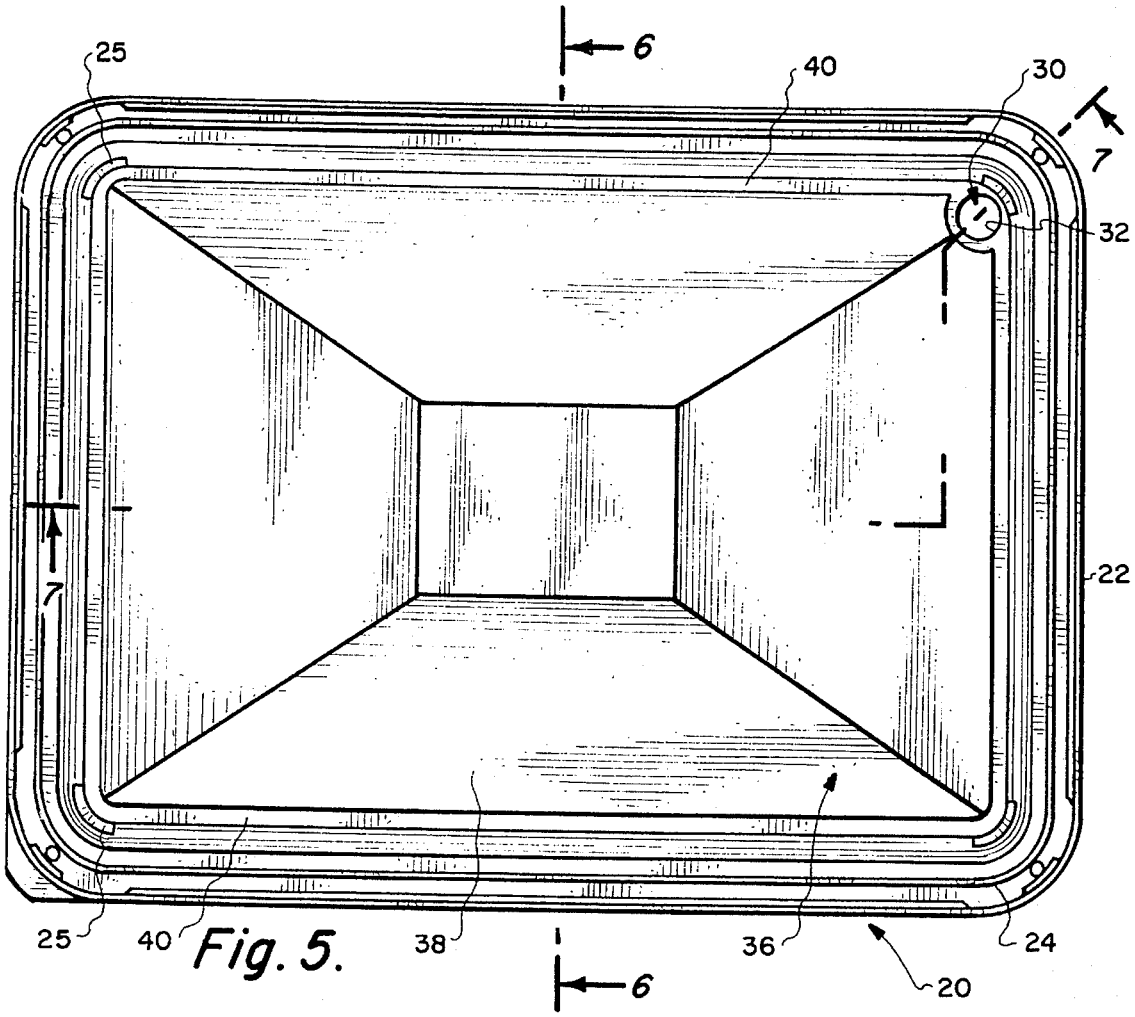
FIG. 5 is a plan view of a preferred embodiment of a container constructed and fabricated in accordance with the teachings of the invention.
Figure 6:
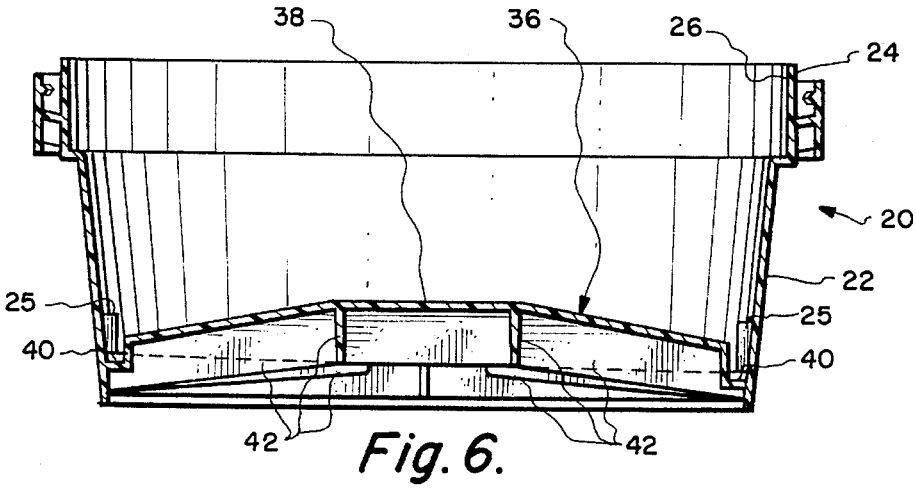
FIG. 6 is a sectional view taken along line 6—6 of FIG. 5.
Figure 7:
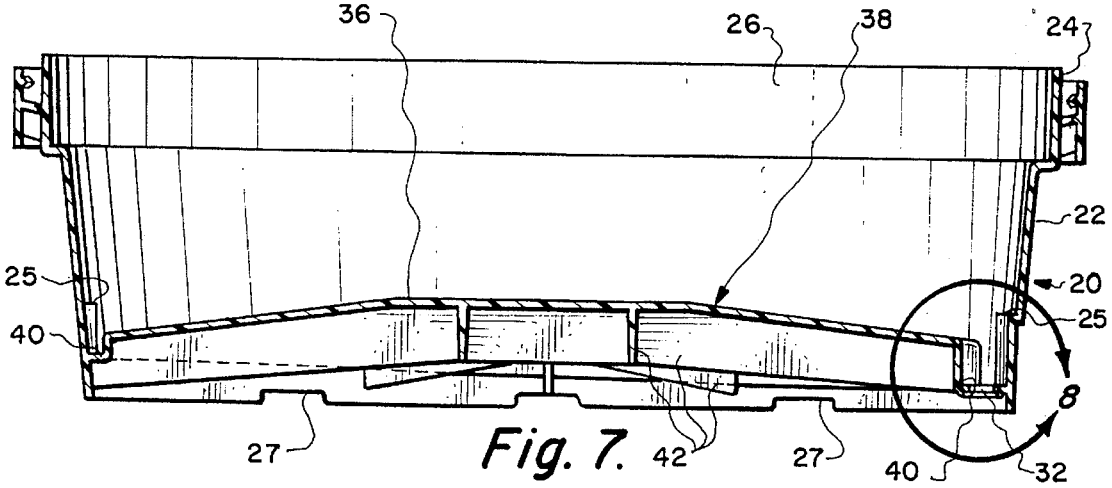
FIG. 7 is a sectional view taken along line 7—7 of FIG. 5.
Figure 8:
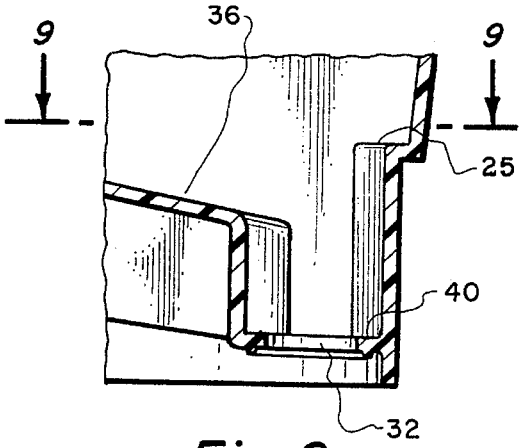
FIG. 8 is a broken sectional view taken along line 8—8 of FIG. 7.
Figure 9:
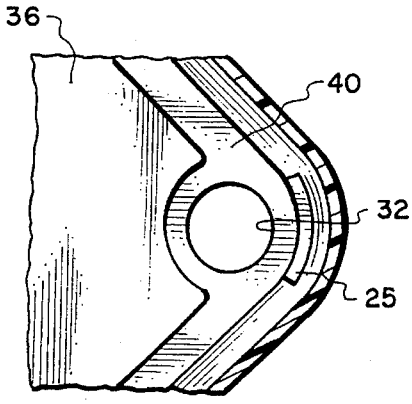
FIG. 9 is a sectional view taken along line 9—9 of FIG. 8.
Figure 16:
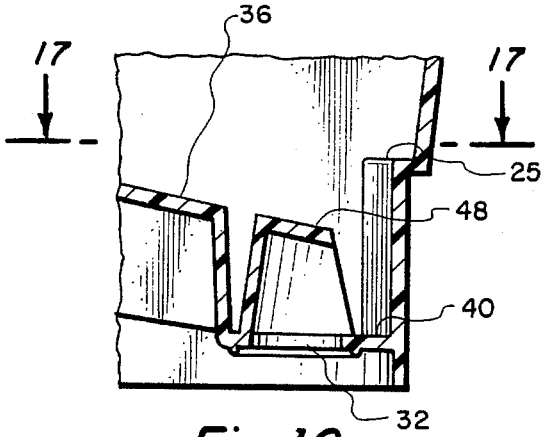
FIGS. 12, 14 and 16 are similar to FIG. 8, but illustrate some of the many alternative embodiments of the drainage means of our invention.
Figure 17:
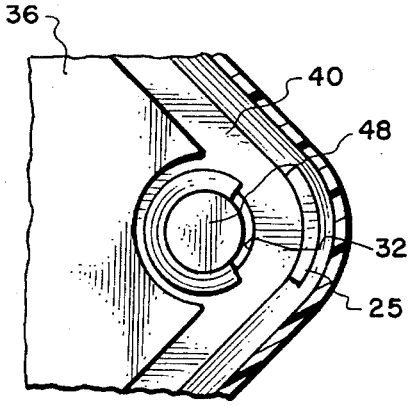
FIGS. 13, 15 and 17 are similar to FIG. 9, but are sectional views taken, respectively, along line 13—13 of FIG. 12, line 15—15 of FIG. 14, and line 17—17 of FIG. 16.

The prior art container 10 is characterized by a base portion 12 and a sidewall portion 14 extending upwardly therefrom when the container is in its normally upright position (see FIGS. 2 and 3, for example). The base portion 12 includes a drainage opening 16 to permit liquid to drain from fish roe slurry (not shown) that is placed into the container. A spacer insert or elevating member 18 is typically placed on the base portion 12 prior to filling the container with roe slurry, and a liner (not shown, but see the description below regarding FIG. 11 of the present invention) is then placed onto the insert 18. The combination of the insert 18 and the liner 34 (see FIG. 11) elevates or spaces the roe slurry from the base portion 12 of the container 10, improving the drainage of liquid therefrom.

Cutback areas 19 are typically provided on a downwardly extending skirt portion 15 of the insert 18, to permit the drained liquid to flow freely between the outside and the inside of the skirt portion. Cutbacks 17 are typically provided on the lower edge of the sidewall portion 14 to facilitate molding, banding of multiple containers together, or other purposes.

The entire prior art container 10 and lid (not shown) is typically injection molding from plastic or other suitably lightweight, flexible, durable material, although other processes and materials can be used. Persons of ordinary skill in the art will understand that, as described herein, the preferred embodiment of the present invention may be fabricated from similar materials and from similar processes, as well as from other materials and processes, so long as the embodiment functions as described hereinbelow.

A preferred embodiment of the container 20 of our invention, FIGS. 5–11 and 22, incorporates many elements similar to that of the prior art device 10. For example, the container 20 includes a sidewall portion 22 having an upper edge 24 defining an opening 26 through which fish roe or other slurry of particulate matter may be inserted into the container 20. The upper edge 24 is preferably engageable with a lid member 28, FIGS. 10 and 11, so that the fish roe or other slurry can be sealed inside the container 20.

Figure 10:
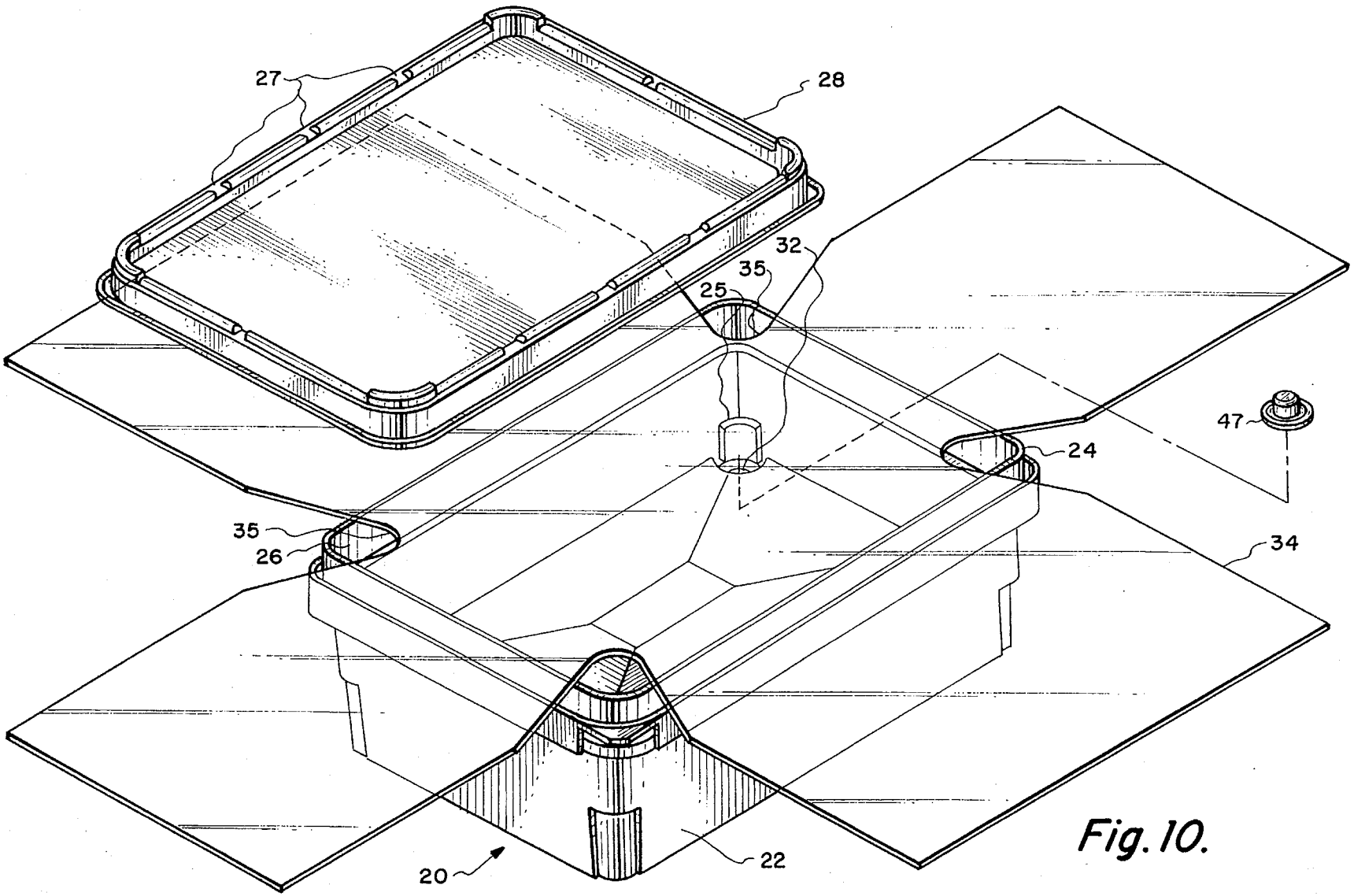
FIG. 10 is an exploded isometric view of a preferred embodiment of a container, lid, liner and plug fabricated in accordance with the teachings of our invention.
Figures 11, 12, 13, 14, 15:
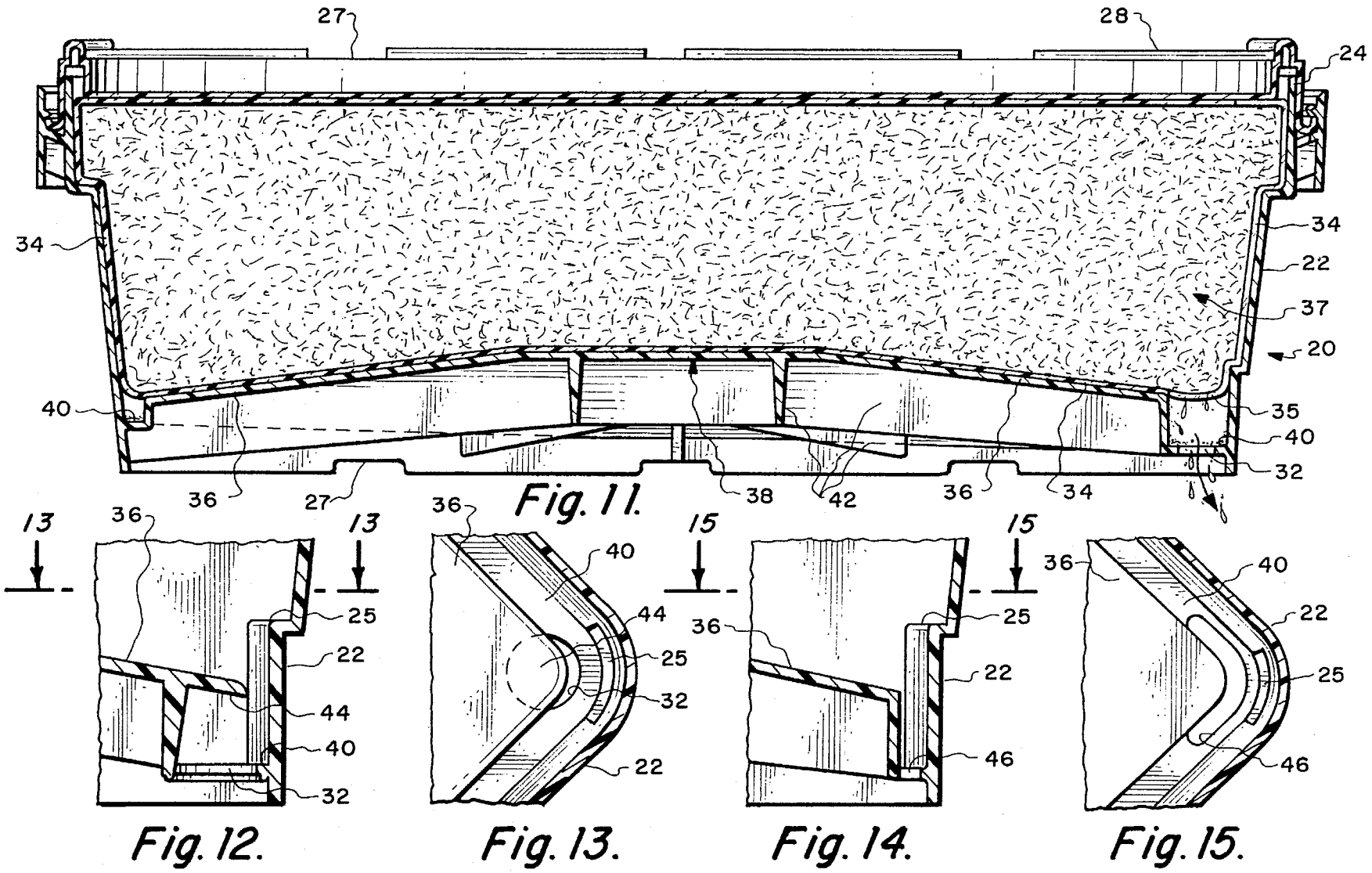
FIG. 11 is a sectional view of a preferred embodiment of a container, lid, and liner (without a plug) fabricated and assembled in accordance with the teachings of our invention, taken along a line similar to line 7—7 of FIG. 5, and illustrating liquid draining from the assembly.
Figure 18:
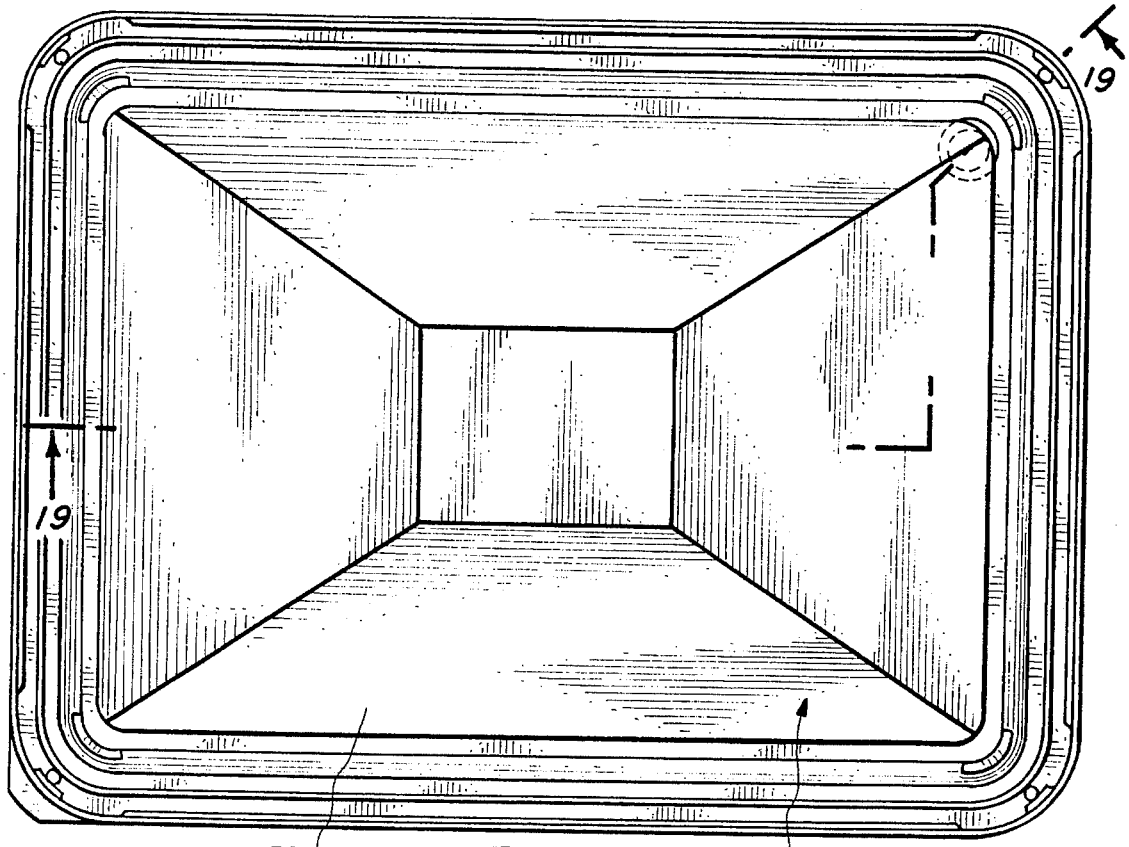
FIG. 18 is a plan view of one of the many alternative embodiments of the invention, illustrating the use of a central elevating member.
Figure 19:
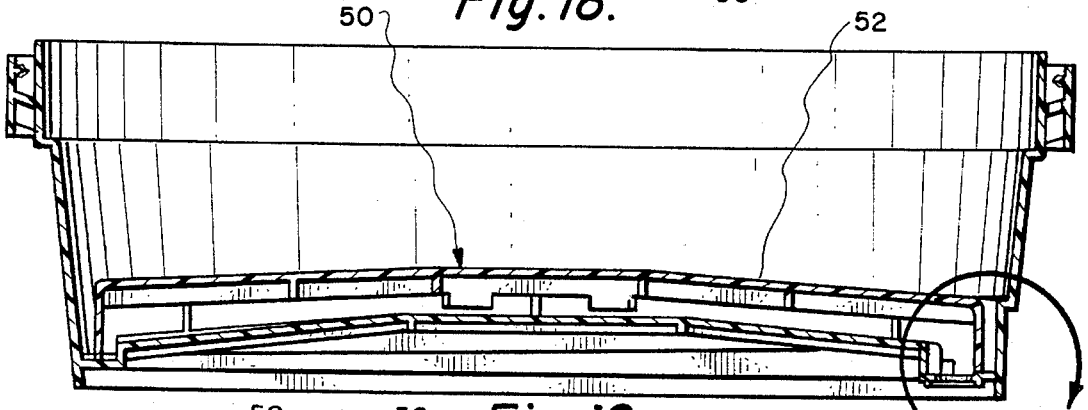
FIG. 19 is a sectional view taken along line 19—19 of FIG. 18.
Figure 20:
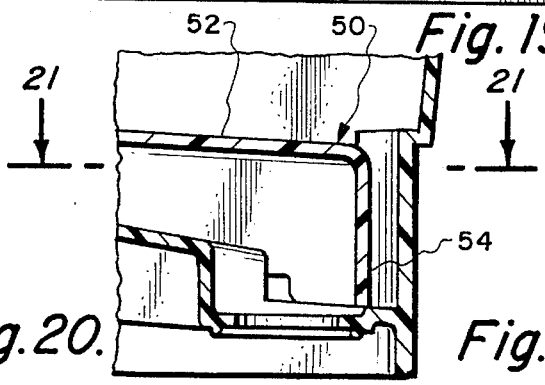
FIG. 20 is a broken sectional view taken along line 20—20 of FIG. 19.
Figure 21:
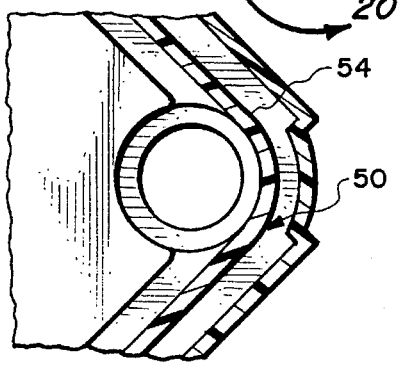
FIG. 21 is a sectional view taken along line 21—21 of FIG. 20.

Also as with the prior art device 10, our invention preferably includes drainage means 30 such as a hole 32 is preferably provided to permit liquid from the slurry to drain from the container 20. Moreover, the container 20 is nestable and stackable with similarly sized and shaped containers (see shoulders 25, which are only representative of structures facilitating stacking and nesting; such shoulders can be any of a variety of shapes, sizes and configurations, and can even be absent). The container 20 also includes cutbacks 27 on the bottom edge of the sidewall portion 22 and the lid member 28, to facilitate banding of the lid to the container and/or of multiple containers together. Furthermore, a liner means 34, FIGS. 10 and 11, is preferably utilized to, among other things, help improve drainage of liquid from the particulate slurry. The liner is preferably fabricated from a clear or transparent plastic film, is of a cross-shaped configuration, and includes corner cut-outs 35 to facilitate the drainage of liquid from a slurry 37 inside the liner 34, as described hereinbelow. The outer flaps of the liner 34 can be folded over the slurry as described below and as shown in the drawings, or can hang over (not shown) the upper edge 24 of the sidewall 22.

The present invention differs from the prior art device 10 in a number of ways. The present container 20 includes a base portion 36 having an elevated central portion 38 and a sluice channel 40 therearound. The channel 40 is formed integrally with the central portion 38 and is configured to receive liquid from the slurry when the container is in its normally upright position.

Preferably, the channel 40 is at the periphery of the base portion 36. Persons of ordinary skill in the art will understand, however, that the channel could be provided in other configurations and at other locations on the container 20. Likewise, although the container 20 is illustrated as rectangular, persons of ordinary skill in the art will understand that the invention can be practiced in a wide range of other container shapes and configurations.

In the preferred embodiment 20, the base portion 36 includes integral supporting ribs 42, FIGS. 6, 7, 11 and 22, which help provide a desirable degree of strength and stability to the shape of the base portion 36. As illustrated, the central portion 38 is configured to urge the liquid from the slurry 37, FIG. 11, toward the channel 40 when the container 20 is in its normally upright position. Persons of ordinary skill in the art will understand that this improves the draining function of the container 20.

As indicated above, the preferred container 20 also includes a drainage opening 32 in the channel 40. The channel 40 is configured, and the opening 32 is located in the channel 40, to urge the liquid from the slurry toward the drainage opening. In the preferred embodiment, this is accomplished by locating the opening 32 at the relatively lowest point of the channel 40, and forming the channel so that it gradually becomes more shallow as one moves from the opening 32 around the periphery of the container 20 to a point on the opposite side of the periphery. That opposite point is, therefore, preferably the highest (or shallowest) part of the channel 40, and the liquid from the slurry therefore tends to run toward the opening 32 once the liquid enters the channel 40.

Figure 11A:
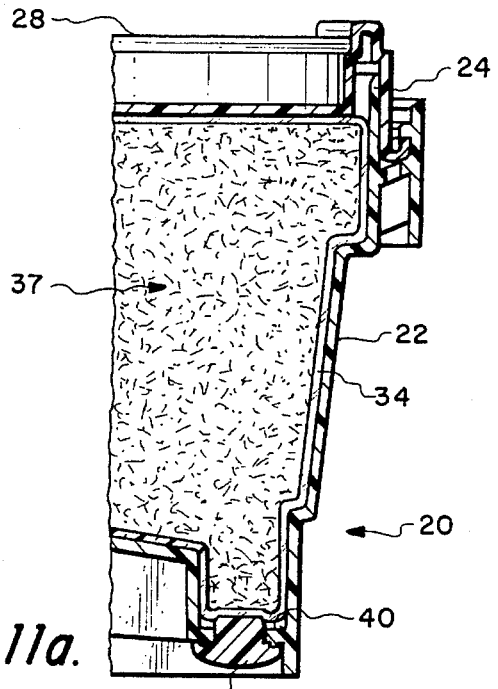
FIG. 11*a* is a broken sectional view similar to the lower right corner of FIG. 11, but illustrating an alternative assembly of the liner means of the invention, and further illustrating the plug means inserted into the drainage opening.
Figure 22:
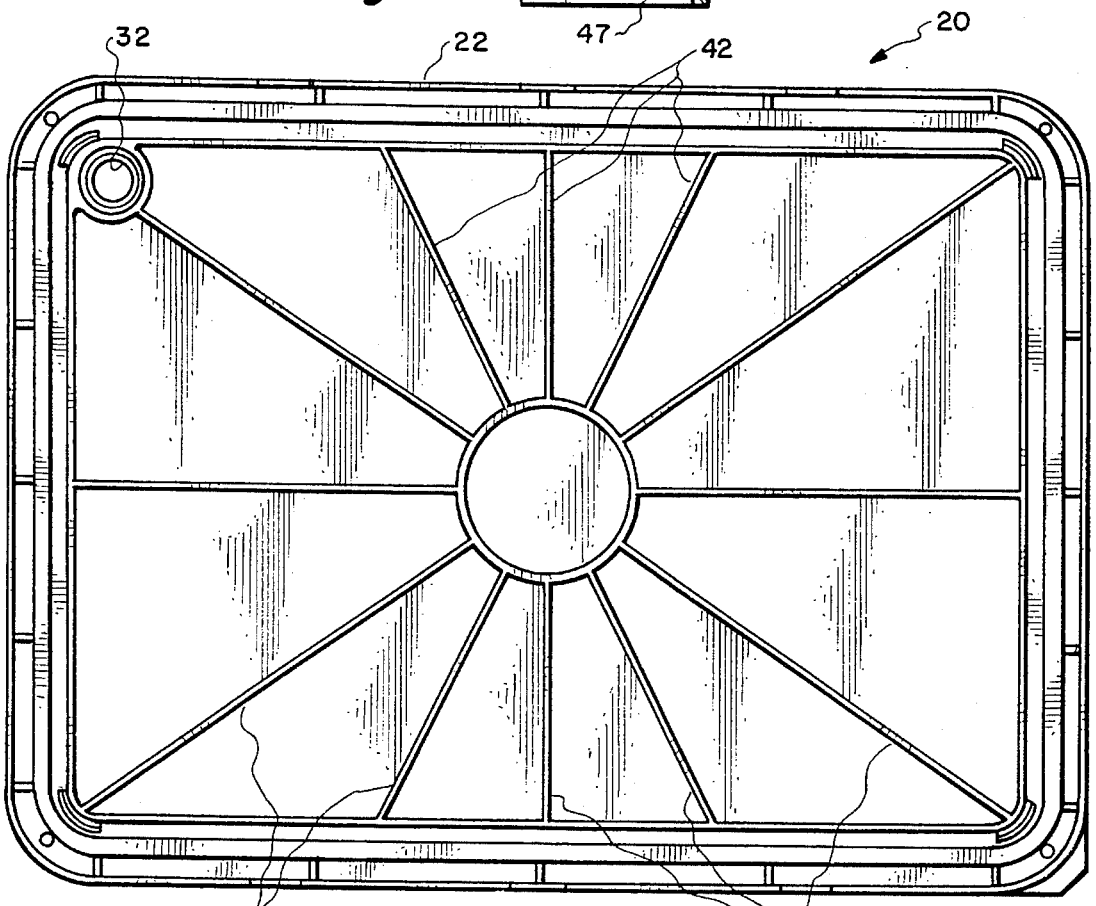
FIG. 22 is a bottom view illustrating a preferred embodiment of support ribs for the container.

The liner means can alternatively be forced into the channel 40, FIG. 11*a*. Once the liquid (or a desired amount thereof) has drained from the slurry 37 and the container 20, plug means such as a plug member 47 can be inserted into the opening 32 to prevent further drainage during subsequent transportation, storage or handling of the container 20. The plug is configured and made from any suitable material (such as rubber, etc.) so as to seal the opening 32 from further drainage and to be sufficiently retained therein.

As indicated above, the container and the components thereof can be provided in a variety of configurations. By way of example and not by way of limitation, some of the many alternative embodiments of the drainage means of our invention are illustrated in FIGS. 12–17. The opening can be covered by a shelf portion 44, FIGS. 12 and 13; can be provided in various shapes such as a curvilinear strip 46, FIGS. 14 and 15; and can be provided with a cap portion 48 over the opening, FIGS. 16 and 17.

Among other things, these embodiments of FIGS. 12–17 provide additional support for the slurry adjacent the drainage opening. This can be especially beneficial, for example, if mechanical pressure if applied to the upper portion of the slurry in the container 20 (such as by pressing on the lid 28) to squeeze liquid from the slurry 37. The additional support provided by embodiments such as FIGS. 12–17 helps ensure that the slurry and/or the particulate matter thereof will not be undesirably forced from the container 20 out the opening 32 (such as might otherwise occur prior to insertion of the plug means in the opening 32).

The container of our invention can alternatively be utilized, FIGS. 18–21, with a separate central elevating platform member 50 similar to prior art elevating members (see member 18, FIGS. 1–4). This provides an additional degree of spacing (and consequent drainage differential) between the bottom of the slurry and the drainage hole in the sluice channel. As with prior art devices, the elevating member 50 preferably has a normally relatively upwardly positioned central portion 52 and peripheral skirt means 54 extending downwardly therefrom. In the preferred alternative of the present invention, however, the skirt means 54 is disposed in is the sluice channel.

A preferred method of our invention is useful for transporting fish roe or other materials requiring draining of liquid therefrom. It includes the steps of providing a container having a base portion and an upwardly extending sidewall portion, with the base portion including a central portion and a sluice channel therearound and formed integrally with the central portion. As discussed above, the channel is configured to receive liquid from the slurry when the container is in its normally upright position. Additional steps of the preferred method include placing a slurry of fish roe into the container, sealing the container (such as by use of a lid member), and transporting the container.

Further steps include providing a drainage opening in the channel, with the channel configured to urge the liquid from the slurry toward the drainage opening, and allowing liquid to drain from the slurry through the opening and subsequently plugging the opening to prevent further drainage. Other steps include placing a central elevating member into the container before placing the slurry of fish roe into the container. As indicated above, this elevates the slurry with respect to the channel and can, among other things, improve the drainage of liquid therefrom. A liner can also be placed in the container prior to placing the slurry of fish roe into the container, as part of the method of our invention.

Thus, by our invention, we provide an improved container and method for transportation, processing, and/or storage of particulate materials or other materials which require some drainage of liquid therefrom. Persons of ordinary skill in the art will understand that, in addition to being usable with slurries of relatively small particles, our invention may have utility with larger particles, even those which might approach the size of the container itself.

The apparatus and method of our invention have been described with some particularity but the specific designs, constructions and steps disclosed are not to be taken as delimiting of the invention in that various modifications will at once make themselves apparent to those of ordinary skill in the art, all of which will not depart from the essence of the invention and all such changes and modifications are intended to be encompassed within the appended claims.

We claim:

1. A container for particulate matter which matter is initially in a slurry, including a base portion and a sidewall portion extending upwardly therefrom when said container is in its normally upright position, said base portion including a particulate-supporting portion and a sluice channel having a substantially U-shaped configuration formed integrally with said particulate-supporting portion, said sluice channel being configured to receive liquid from the slurry when said container is in its normally upright position and including channel sidewalls that are substantially vertical when said container is in its normally upright position; said particulate-supporting portion being sloped toward said sluice channel to urge fluid to drain from the slurry into said channel, and said sluice channel including a sloped bottom portion capable of directing the liquid toward a point coincident with a drainage opening therethrough.

2. The container of claim 1, in which said channel is at the periphery of said base portion.

3. The container of claim 1, in which said container has at least one corner when viewed in plan view and said channel extends from said corner to said drainage opening.

4. The container of claim 1, in which said drainage opening is adjacent said sidewall portion of said container.

5. The container of claim 1 or claim 2 or claim 3 or claim 4, further including a separate platform member having a normally relatively upwardly positioned central portion and spacing means extending downwardly therefrom to space said central portion from said base portion.

6. The container of claim 5, in which said separate platform member is capable of being contained within said container without said platform member being deformed or destroyed.

7. The container of claim 6, in which said channel includes a bottom portion thereof constituting a surface having a substantially continuous downward gradient toward said drainage opening when said container is in its normally upright position.

8. The container of claim 1 or claim 2, further including liner means overlying said channel to help prevent the particulate matter from falling into said sluice channel when said container is in its normally upright position.

9. The container of claim 1 or claim 2, in which said particulate-supporting portion constitutes a majority of said base portion.

10. The container of claim 1 or claim 2, in which the width of said particulate-supporting portion in a given direction is at least twice the width of the combined width of said sluice channel in the same direction.

11. A plastic, injection-molded container and associated lid for transporting fish roe which is initially in a slurry, said container having a bottom and a sidewall portion extending upwardly therefrom and defining an opening coverable by said lid, said bottom including a central elevating member and a downwardly extending drainage channel formed integrally with said bottom, said channel having a drainage opening at a normally lowest point therein, said bottom configured to urge liquid from said slurry toward said channel, and said channel configured to urge the liquid toward said drainage opening, further including a supplemental central elevating member having a central portion including one or more surfaces sloped toward said channel and a skirt portion extending normally downwardly therefrom, said skin configured to interfit into said channel.

12. The container and lid combination of claim 11, further including plug means for plugging said drainage opening after liquid has drained therefrom.

13. The container and lid combination of claim 11, said channel having substantially vertical opposing side portions and a bottom portion sloped from a relatively higher point toward said normally lowest point.

14. A container for particulate matter which matter is initially in a slurry, including a base portion and a sidewall portion extending upwardly therefrom when said container is in its normally upright position, said base portion including a central portion and a sluice channel therearound, said channel being formed integrally with said central portion and configured to receive liquid from the slurry when said container is in its normally upright position, further including a separate central platform member having a normally relatively upwardly positioned central portion and skirt means extending downwardly therefrom, said central portion configured to support the majority of the particulate matter and to urge fluid to drain from the slurry into said channel via one or more surfaces sloped toward said channel, said skirt means engagable in said sluice channel, further including a drainage opening in said channel, with said channel configured to urge the liquid from the slurry toward said drainage opening.

* * * * *

UNITED STATES PATENT AND TRADEMARK OFFICE

CERTIFICATE OF CORRECTION

PATENT NO : 5,615,798

DATED : April 1, 1997

INVENTOR(S) : Frano Luburic, Fullerton; C. Richard Roper, Orange, both of Calif.

It is certified that error appears in the above-identified patent and that said Letters Patent is hereby corrected as shown below:

Column 2, line 63, "are" should read --art--.

Column 8, line 3, in Claim 11, "skin" should read --skirt--.

Signed and Sealed this

Fourteenth Day of October, 1997

*Attest:*

*Attesting Officer*

BRUCE LEHMAN

*Commissioner of Patents and Trademarks*